United States Patent [19]

Schulz

[11] Patent Number: 4,760,803

[45] **Date of Patent: * Aug. 2, 1988**

[54] PROCESS FOR GENERATING ENERGY IN A FURNACE OR COMBUSTION ENGINE

[76] Inventor: Johann G. Schulz, 201 Conover Rd., Pittsburgh, Pa. 15208

[ * ] Notice: The portion of the term of this patent subsequent to May 26, 2004 has been disclaimed.

[21] Appl. No.: 4,542

[22] Filed: Jan. 16, 1987

Related U.S. Application Data

[63] Continuation-in-part of Ser. No. 790,530, Oct. 23, 1985, Pat. No. 4,668,243.

[51] Int. Cl.[4] ..... F23B 7/00; F02C 3/20; C10L 1/00

[52] U.S. Cl. ..... 110/341; 60/39.461; 44/27; 44/53; 110/346; 431/2

[58] Field of Search ..... 44/1 R, 1 D, 1 E, 27, 44/33, 51, 53, 56; 60/39.461; 110/341, 347, 346; 431/2

[56] References Cited

U.S. PATENT DOCUMENTS

| | | | |
|---|---|---|---|
| 1,729,763 | 10/1929 | Florez | 110/341 |
| 2,058,051 | 10/1936 | Bailey | 110/341 |
| 3,954,381 | 5/1976 | Marecaux | 431/2 |
| 4,138,980 | 2/1979 | Ward | 431/2 |
| 4,420,930 | 12/1983 | Beuther et al. | 60/39.461 |

*Primary Examiner*—Carl F. Dees
*Attorney, Agent, or Firm*—Joseph J. Carducci

[57] ABSTRACT

A process for generating energy in a furnace or combustion engine which comprises burning therein the novel alcohol-soluble portion of the product obtained as a result of the mild reaction of a lignin-containing material, such as peat, with aqueous nitric acid.

63 Claims, No Drawings

PROCESS FOR GENERATING ENERGY IN A FURNACE OR COMBUSTION ENGINE

This application is a continuation-in-part application of my U.S. Pat. Application Ser. No. 790,530 for Energy Generating Process and Novel Fuel Therefor, filed Oct. 23, 1985 now U.S. Pat. No. 4,668,243.

BACKGROUND OF THE INVENTION

1. Field of the Invention

This invention relates to a novel fuel composition containing the alcohol-soluble portion of the product obtained as a result of the mild reaction of a lignin-containing material with nitric acid and a component selected from the group consisting of water, methanol, ethanol, mixtures thereof, mixtures of lower alcohols and a hydrocarbon fuel.

2. Description of the Prior Art

Lignin-containing materials, such as peat and wood, are available in large amounts and are known to have fuel value since they are susceptible to combustion. However, since their fuel value is comparatively low, their use is generally limited to heating applications and steam generation. It would be highly desirable, therefore, to render such lignin-containing materials more attractive as fuels, or as components of fuels, and to enlarge on their considerable potential as an energy source.

SUMMARY OF THE INVENTION

I have discovered that lignin-containing materials can be upgraded as fuels and fuel additives and their utilization, therefore, can be greatly extended by subjecting the same to a mild reaction with nitric acid and recovering as said novel fuel, or fuel additive, the alcohol-soluble portion of the nitric acid reaction product so obtained for use in generating energy in a furnace or a combustion engine.

By a "lignin-containing material," I mean to include any material that includes in its normal state at least about five wight percent lignin, generally at least about ten weight percent lignin. As an example, on a water-free basis, the lignin-containing material can contain from about five to about 100 weight percent lignin, generally from about 20 to about 100 weight percent lignin. By lignin I mean a high molecular derivative of phenylpropane, wherein the phenyl groups are substituted with one to two methoxy groups and the propane side chains with hydroxyl groups. The phenylpropane units are linked with each other from the side chain to the nucleus partially by carbon-to-carbon, partially by ether linkages. (Reference: Lignin Structures and Reactions, Advances in Chemistry, Series #59, American Chemical Society publications #59). Remaining organic material associated with the lignin-containing material can be cellulose, hemicellulose, bitumen, humic acid, etc. the lignin-containing material in its normal state usually contains large amounts of water, for example. from about 0 to about 95 weight percent, generally from about 20 to about 95 weight percent water. Examples of lignin-containing materials that are particularly attractive for use herein include peat, wood, biomass, such as bagasse, and lignin, etc. Peat is the partially decomposed residue of dead plants and animal microorganisms associated with about 80–90 weight percent of water.

The novel fuel for use in generating energy in a furnace or combustion engine, in accordance with the invention defined and claimed herein, is easily obtained by subjecting the above-defined lignin-containing material or mixtures of lignin-containing materials to a mild reaction with nitric acid and then recovering from the nitric acid reaction product the alcohol-soluble portion thereof. Thus, nitric acid can be added to the above-defined lignin-containing material, while stirring the mixture, until the reaction of the nitric acid with the lignin-containing material has continued to the extent desired. During the reaction water and nitrogen oxides produced, and any other volatile materials that may result from the reaction, are permitted to escape. Solid reaction product obtained is then subjected to extraction with an aliphatic alcohol or mixtures of aliphatic alcohols having from 1 to 10 carbon atoms, particularly from 1 to 6 carbon atoms. These include methanol, ethanol, normal propanol, isopropanol, butanol, decanol and mixtures of the lower alcohols, such as those obtained in the industrial production of fuel grade methanol and ethanol. If desired, any suitable polar solvent, for example, such as defined hereinafter can also be used as an extractant.

The conditions that can be used above in subjecting the lignin-containing material to reaction with nitric acid must be mild. The reaction can be carried out using an aqueous mixture containing the lignin-containing material and aqueous nitric acid. The nitric acid used can have a concentration of about 5 to about 100 weight percent nitric acid, preferably about 15 to about 70 weight percent nitric acid. The mixture can contain about 0 to about 95 weight percent water, preferably about 40 to about 80 weight percent water. On a weight basis, the lignin-containing material (on a dry basis) and the nitric acid (as 100 percent nitric acid) can be in the range of about 1:0.1 to about 1:10, preferably about 1:1 to about 1:2. The above is mixed while it is maintained in a temperature range of about −10° to about 150° C., preferably about 20° to about 100° C., and a pressure of about 14.5 to about 1000 pounds per square inch gauge, preferably about 14.5 to about 100 pounds per square inch gauge, for about 1 minute to about 10 hours, preferably about 0.5 to about 2 hours. The resulting reaction product is then subjected to extraction with any suitable polar solvent, for example, a ketone, such as acetone, methylethylketone, cyclohexanone, etc., an alcohol, such as methanol, ethanol, normal propanol, isopropanol, butanol, decanol, and mixtures of the lower alcohols, such as those obtained in the industrial production of fuel grade methanol and ethanol, etc., tetrahydrofuran, dioxane, etc., or mixtures thereof. The extraction can be carried out at temperatures in the range of about 0° to about 200° C. and the extraction can be continued until no further extract is obtained. Removal of polar solvent from the extract can be effected by subjecting the extract to drying or distillation. The solid material obtained is the novel alcohol soluble product used herein.

If desired the procedural steps defined in U.S. Pat. No. 4,052,448, dated Oct. 4, 1977, of Schulz, et al, can be used in reacting the lignin-containing material with nitric acid, provided the reaction parameters defined above are maintained.

The nitric acid reaction product obtained above, as the novel fuel herein, contains both water-soluble and water-insoluble components. The water-soluble components will be in the range of about 10 to about 95 weight percent, generally about 40 to about 70 weight percent. I have found that since the lignin-containing materials, as defined herein, contain phenyl groups with a large number of aliphatic chains linking the same to each other, under the mild reaction conditions defined above, cleavage within the molecule is easily effected by oxidation, without resultant decarboxylation, and nitration also occurs to varying extents. The resultant reaction product so obtained thus has a molecular weight substantially lower than the lignin-containing material that was subjected to reaction with nitric acid and now additionally carries carboxyl and nitro groups.

The nitric acid reaction product obtained above can be used as such herein for generating energy in a furnace or a combustion engine by burning the same therein. Combustion engines that can be used include internal combustion engines, such as a Diesel engine, or a turbine, or an external combustion engine, such as a steam engine. Alternatively, the product can be used to prepare a novel fuel composition for use herein in a furnace or a combustion engine. In one embodiment, the product can be dissolved in an alcohol, such as methanol, ethanol, mixtures thereof and mixtures of lower alcohols such as those obtained in the industrial production of fuel-grade methanol or ethanol wherein, the reaction product can amount to about 3 to about 95 weight percent, preferably about 25 to about 75 weight percent, of the final solution, with the remainder being the alcohol used. This solution, which will be discussed further below, is an excellent Diesel fuel. Alternatively, a slurry can be prepared that includes the nitric acid reaction product and a hydrocarbon fuel wherein the nitric acid reaction product can amount to about 5 to about 95 weight percent, preferably about 30 to about 80 weight percent, of the final product. By "hydrocarbon fuel," I mean to include liquid hydrocarbons, such as petroleum fractions, oils resulting from coal liquefaction or other coal conversion processes, the extract from oil shale and tar sands, liquids resulting from the pyrolysis of organic matter, etc. Additionally, a slurry can also be prepared that includes the nitric acid reaction product and up to about 30 percent, preferably about 20–25 percent, of water.

As pointed out above, the solution of methanol, ethanol, mixtures thereof, and mixtures of lower alcohols, such as fuel-grade methanol and fuel-grade ethanol with the nitric acid reaction product results in an unexpectedly well performing Diesel fuel. In order for a material to be effective when incorporated into an alcohol for a Diesel fuel, it must produce satisfactory ignition promotion, have excellent solubility in the alcohol and equally important possess viscosity and lubricity properties close to or equivalent to those of conventional petroleum-derived Diesel fuel. I have found that the nitric acid reaction product defined herein, when added to one of the defined alcohols, will result in a Diesel fuel having all of the defined desired properties.

I have found, for example, that the product obtained when peat is subjected to a mild reaction with nitric acid, as defined above, is infinitely soluble in the alcohols defined immediately above. This is believed to result from the presence of a large number of aliphatic substituents in the peat and carboxyl groups in the resulting reaction product. Additionally, liquidity of the solute at injector nozzle temperatures is highly desirable, particularly in a "solution-type" Diesel fuel, since solvent evaporation, after engine shut-off, can leave behind solid residues, especially in the fuel injector, resulting in problems to restart the engine. Since the product containing the defined alcohol, for example, methanol, and nitric acid reaction product, posesses viscosities (for example, 7 centipoise at 25° C.) and lubricity close to those of conventional Diesel fuels, it can be injected with standard injection systems. High viscosities and lack of sufficient lubricity are undesirable, for Diesel fuels having such characteristics can cause wear of pump elements, resulting in engine failure. On the other hand, no mechanical problems were encountered with the novel fuels herein. That the nitric acid reaction product defined herein is a good ignition promoter is shown by the fact that the products containing equal amounts by weight of methanol and the alcohol-soluble portion of the nitric acid reaction products using peat as the lignin-containing charge material have ignition delays comparable to good Diesel fuels with a cetane number of 52. Essentially smoke-free emissions, reduced nitric oxide production compared to conventional Diesel fuels and an increase in power output over methanol alone were consistently observed.

The above results are surprising. When coal or lignite are subject to reaction with nitric acid, for example, as in U.S. Pat. No. 4,052,448 to Schulz, et al, referred to above, or in U.S. Pat. No. 4,278,443 to Beuther, et al, substantially all of the organic reaction product obtained is water-insoluble, whereas herein generally at least about 50 weight percent is water soluble. The water-soluble product obtained in said patents has no ignition properties at all of its own when added to methanol, for example, for use in a Diesel engine. Not only is the novel fuel composition herein characterized by the fact that generally more than half of it is water-soluble, but that when added to an alcohol, for example, methanol, all of its components including its water-soluble portion, are excellent ignition promoters therein. Therefore, the use of an extraneous ignition promoter, such as an alkyl nitrate (for example, octyl nitrate), is not required. Infinite solubility of the nitric acid reaction product of peat in the alcohol, for example, methanol, and desired viscosity, lubricity and liquidity properties of the resulting solution when used in a Diesel engine, are lacking in the comparable product when using the nitric acid reaction product of the Schulz, et al and the Beuther, et al patents referred to above.

When the lignin-containing material used herein to make the novel fuel is peat and the nitric acid reaction product is subjected to extraction with one of the polar solvents defined above, for example, methanol, most of the contaminants that were in the original peat remain in the insoluble residue and the extract contains only small amounts of polar solvent-soluble metal contaminants. These contaminants can be removed from the extract by any suitable means, for example, by treating the same with an ion-exchange resin, such as "Amberlyst 15" acid ion exchange resin.

DESCRIPTION OF PREFERRED EMBODIMENTS

A number of reactions was carried out as follows. Aqueous nitric acid was added to Finnish high humification peat uniformly over a period of 0.75 hours while the mixture was agitated. While the resulting mixture was stirred, it was maintained at selected temperatures and ambient pressure for two hours after the nitric acid addition. At the end of the reaction period, residual water was removed from the reaction product by evaporation, and the dry reaction product remaining was extracted exhaustively with methanol at ambient temperature and ambient pressure. The methanol extracts thus obtained were then evaporated for the recovery of methanol-soluble reaction product (MSP), which contained both water-insoluble components and water-soluble components. The relative amounts of water-insoluble components and water-soluble components present were determined by extracting the total solids with water. In Table I, the reactions were each carried out at 85° C. and the weight ratio of nitric acid to peat was varied. The results obtained on analysis of the reaction product are tabulated in Table I.

TABLE I

| Run No. | 1 | | 2 | | 3 | | 4 | |
|---|---|---|---|---|---|---|---|---|
| $HNO_3$/Peat Weight Ratio | 0.25:1 | | 0.5:1 | | 1:1 | | 2:1 | |
| Product Analysis | % Selectivity | NE* | % Selectivity | NE | % Selectivity | NE | % Selectivity | NE |
| Intermediates Plus Ash | 75.0 | 248 | 61.5 | 256 | 28.0 | 250 | 16.3 | 185 |
| Water-Insoluble MSP | 14.0 | 215 | 18.0 | 219 | 31.0 | 149 | 28.8 | 153 |
| Water-Soluble MSP | 13.0 | 138 | 20.9 | 138 | 35.0 | 110 | 47.0 | 86 |
| Total MSP | 27.0 | | 38.9 | | 66.0 | | 75.8 | |
| Ratio of Water-Insoluble MSP to Water-Soluble MSP | 1:1 | | 0.9 | | 0.9 | | 0.6 | |

In Table I, as elsewhere, "NE" designates the neutral equivalent of the fraction referred to and "Intermediates Plus Ash" refers to the partially reacted residual product and contaminants. Note that nitric acid to peat ratios have a pronounced effect on peat conversion and the ratio of water-insoluble to water-soluble components produced. In all cases, the water-soluble components were present in at least the same amount as the water-soluble components but generally much higher.

In Table II, the comparable effects of nitric acid to peat ratios were studied at different temperatures.

TABLE II

| Run No. | 5 | | 6 | | 7 | | 8 | |
|---|---|---|---|---|---|---|---|---|
| $HNO_3$/Peat Weight Ratio | 1:1 | | 1:1 | | 2:1 | | 2:1 | |
| Temperature, °C. | 85 | | 50 | | 50 | | 85 | |
| Product Analysis | % Selectivity | NE | % Selectivity | NE | % Selectivity | NE | % Selectivity | NE |
| Intermediates Plus Ash | 28.0 | 250 | 28.4 | 214 | 19.1 | 216 | 16.3 | 185 |
| Water-Insoluble MSP | 31.0 | 149 | 32.3 | 161 | 30.0 | 169 | 28.8 | 153 |
| Water-Soluble MSP | 35.0 | 110 | 36.1 | 105 | 53.8 | 94 | 47.0 | 86 |
| Total MSP | 66 | | 68.4 | | 83.8 | | 75.8 | |
| Ratio of Water-Insoluble MSP to Water-Soluble MSP | 0.9 | | 0.9 | | 0.6 | | 0.6 | |

In Table II, it can be seen that variations in temperature from 50° to 85° C. have little effect on the amount of product obtained and on product distribution.

The data in Table III show the effect of temperature on the reaction product obtained wherein the nitric acid to peat ratio was maintained at 1:1.

TABLE III

| Run No. | 9 | | 10 | | 11 | | 12 | | 13 | |
|---|---|---|---|---|---|---|---|---|---|---|
| Temperature, °C. | 25 | | 35 | | 50 | | 65 | | 85 | |
| Product Analysis | % Selectivity | NE | % Selectivity | NE | % Selectivity | NE | % Selectivity | NE | % Selectivity | NE |
| Intermediates Plus Ash | 47.4 | 226 | 37.3 | 213 | 28.4 | 214 | 35.0 | 246 | 28.0 | 250 |
| Water-Insoluble MSP | 29.7 | 163 | 38.1 | 149 | 32.3 | 161 | 33.0 | 163 | 31.0 | 149 |
| Water-Soluble MSP | 30.0 | 125 | 33.0 | 95 | 36.1 | 105 | 36.0 | 102 | 35.0 | 110 |
| Total MSP | 59.7 | | 77.1 | | 68.4 | | 69.0 | | 66.0 | |
| Ratio of Water-Insoluble MSP to Water-Soluble MSP | 1 | | 1.2 | | 0.9 | | 0.9 | | 0.9 | |

The data in Table III shows that while the temperature is rate determining it has hardly any effect on product distribution.

In Table IV results from peats of different humification, high, medium, and low, are tabulated. Humification levels signify age of peat and corresponding degrees of decomposition. The nitric acid to peat weight ratio was 1:1 and the reaction temperature 50+ C.

TABLE IV

| Run No. | 14 | | 15 | | 16 | |
|---|---|---|---|---|---|---|
| Humification | High | | Medium | | Low | |
| Product Analysis | % Selectivity | NE | % Selectivity | NE | % Selectivity | NE |
| Intermediates Plus Ash | 28.4 | 214 | 35.5 | 189 | 26.6 | 172 |
| Water-Insoluble MSP | 32.3 | 161 | 21.7 | 147 | 18.8 | 145 |
| Water-Soluble MSP | 36.1 | 105 | 34.9 | 99 | 47.2 | 110 |
| Total MSP | 68.4 | | 56.6 | | 66 | |
| Ratio of Water-Insoluble MSP to Water-Soluble MSP | 0.9 | | 0.6 | | 0.4 | |

Results with peats of various age differ mainly in product distribution. Older, high humification peat will give about equal amounts fo water-insoluble and water-soluble components. Products from low humification peat predominates in the water-soluble components. In all cases the reaction product obtained from all peats appear to be similar as evidenced by their neutral equivalent and solubility in methanol. Analysis of the methanol-soluble product from Run No. 14 is typical. This is shown below in Table V.

TABLE V

| | Weight Percent |
|---|---|
| Carbon | 45.26 |
| Hydrogen | 5.08 |
| Nitrogen | 3.23 |
| Sulfur | 1.84 |
| Oxygen | 43.81 |
| Ash | 0.78 |
| Hydrogen to Carbon Ratio | 0.11 |

Run No. 17

In this run Finnish Peat was used. Aqueous nitric acid having a concentration of 70 weight percent was used and added to the peat over a two-hour period, followed by a two-hour period all at 50° C. Weight ratio of nitric acid (as 100 percent nitric acid) to peat was 1:1. No water was used as diluent. The air-dried peat charge contained a mixture of peats of high, medium and low humification with varying moisture content. The dried products were slurried at ambient temperature with sufficient amounts of methanol to permit their removal from the reactor flask. The slurries were filtered and re-extracted with methanol to generate methanol-soluble reaction products. Methanol-insoluble filter cakes were recycled to the solubilization step alone or along with fresh peat. Methanol product solutions were evaporated to adjust their content of methanol-soluble reaction product to 50 weight percent. Moisture content of the products so obtained varied from four to 12 weight percent, with ash around three weight percent. Removal of residual metal contaminants was carried out by contacting the methanol solutions with "Amberlyst 15" acid ion exchange resin. The product after this treatment contained 0.42 weight percent ash. Further removal of ash could still be obtained by repeating this procedure. Table VI below sets forth the elemental analysis of the original solid nitric acid reaction product.

TABLE VI

| | Weight Percent |
|---|---|
| Carbon | 49.0 |
| Hydrogen | 4.9 |
| Nitrogen | 3.7 |
| Sulfur | 0.5 |
| Oxygen | 39.6 |
| Ash | 2.4 |
| Neutral Equivalent | 119 |
| BTU/Pound | 7718 |

Viscosities of the 50 percent by weight methanol solution are given below in Table VII.

TABLE VII

| Temperature, °C. | Centipoise |
|---|---|
| −9.9 | 66 |
| 0 | 36.6 |
| 10.1 | 21.5 |
| 25.2 | 13.2 |
| 40 | 5.3 |
| BTU/Pound | 7266 |

Run No. 18

A Diesel fuel was prepared containing 50 weight percent of the total methanol-soluble product obtained in Run No. 14 and 50 weight percent methanol. A series of runs was carried out using one-gallon quantities of the Diesel fuel so prepared to power a CLR Diesel test engine, manufactured by Lab Equipment Corporation of Mooresville, Ind. In each run the engine was started with methanol containing about five weight percent of octyl nitrate as ignition promoter and one weight percent of castor oil as lubricant. After about 5 minutes of operation in this mode, injection of the methanol fuel was discontinued and operation was continued using the novel Diesel fuel prepared above. In each case, operation was continued over a period of 30 minutes until the fuel was exhausted. In each case where the test fuel was used the engine ran smoothly, with a power output in excess of the power output using methanol alone. No visible emissions of particulates were noted.

Obviously, many modifications and variations of the invention, as hereinabove set forth, can be made without departing from the spirit and scope thereof, and therefore only such limitations should be imposed as are indicated in the appended claims.

I claim:

1. Process for generating energy in a furnace or a combustion engine which comprises burning in said furnace or said combustion engine the fuel composition comprising the alcohol soluble product obtained as the result of the mild reaction of a lignin-containing material with nitric acid.

2. The process of claim 1 wherein said lignin-containing material is peat.

3. The process of claim 1 wherein said lignin-containing material is wood.

4. The process of claim 1 wherein said lignin-containing material is bagasse.

5. The process of claim 1 wherein said lignin-containing material is lignin.

6. The process of claim 1 wherein said alcohol in which said novel fuel composition is soluble is selected from the group consisting of methanol, ethanol, mixtures thereof, and mixtures of lower alcohols.

7. The process of claim 1 wherein said reaction is carried out with nitric acid at a temperature of about −10° C. to about 150° C.

8. The process of claim 1 wherein said reaction is carried out with nitric acid at a temperature of about 20° C. to about 100° C.

9. The process of claim 1 wherein said lignin-containing material is peat, said alcohol in which said novel fuel composition is soluble is selected from the group consisting of methanol, ethanol, mixtures thereof, and mixtures of lower alcohols, and said reaction is carried out with nitric acid at a temperature of about −10° C. to about 150° C.

10. The process of claim 9 wherein said temperature is in the range of about 20° C. to about 100° C.

11. The process of claim 1 wherein said lignin-containing material is wood, said alcohol in which said novel fuel composition is soluble is selected from the group consisting of methanol, ethanol, mixtures thereof, and mixtures of lower alcohols, and said reaction is carried out with nitric acid at a temperature of about −10° C. to about 150° C.

12. The process of claim 11 wherein said temperature is in the range of about 20° C. to about 100° C.

13. The process of claim 1 wherein said lignin-containing material is bagasse, said alcohol in which said novel fuel composition is soluble is selected from the group consisting of methanol, ethanol, mixtures thereof, and mixtures of lower alcohols, and said reaction is carried out with nitric acid at a temperature of about −10° C. to about 150° C.

14. The process of claim 13 wherein said temperature is in the range of about 20° C. to about 100° C.

15. The process of claim 1 wherein said lignin-containing material is lignin, said alcohol in which said novel fuel composition is soluble is selected from the group consisting of methanol, ethanol, mixtures thereof, and mixtures of lower alcohols, and said reaction is carried out with nitric acid at a temperature of about −10° C. to about 150° C.

16. The process of claim 15 wherein said temperature is in the range of about 20° C. to about 100° C.

17. The process for generating energy in a furnace or a combustion engine which comprises burning in said furnace or said combustion engine the fuel composition containing (1) the alcohol-soluble product obtained as a result of the mild reaction of a lignin-containing material with nitric acid, and (2) a component selected from the group consisting of water, methanol, ethanol, mixtures thereof, mixtures of lower alcohols, and a hydrocarbon fuel.

18. The process of claim 17 wherein said lignin-containing material is peat.

19. The process of claim 17 wherein said lignin-containing material is wood.

20. The process of claim 17 wherein said lignin-containing material is bagasse.

21. The process of claim 17 wherein said lignin-containing material is lignin.

22. The process of claim 17 wherein the alcohol in which said product is soluble is selected from the group consisting of methanol, ethanol, mixtures thereof, and mixtures of lower alcohols.

23. The process of claim 17 wherein said reaction is carried out at a temperature of about −10° C. to about 150° C.

24. The process of claim 17 wherein said reaction is carried out at a temperature of about 20° C. to about 100° C.

25. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about −10° C. to about 150° C.

26. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about 20° to about 100° C.

27. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about −10° C. to about 150° C.

28. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about 20° C. to about 100° C.

29. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about −10° C. to about 100° C.

30. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about 20° C. to about 100° C.

31. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about −10° C. to about 100° C.

32. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about 20° C. to about 100° C.

33. The process of claim 17 wherein said component is selected from the group consisting of methanol, ethanol, mixtures thereof, and mixtures of lower alcohols.

34. The process of claim 33 wherein said component is present in an amount of about 5 to about 97 weight percent.

35. The process of claim 33 wherein said component is present in an amount of about 25 to about 75 weight percent.

36. The process of claim 17 wherein said component is a liquid hydrocarbon fuel in an amount of about 5 to about 95 weight percent.

37. The process of claim 17 wherein said component is a liquid hydrocarbon fuel in an amount of about 20 to about 70 weight percent.

38. The process of claim 17 wherein said component is water in an amount of up to about 30 weight percent.

39. The process of claim 17 wherein said component is water in an amount ranging from 20 to 25 weight percent.

40. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about −10° to about 150° C., and wherein said component is selected from the group consisting of methanol, ethanol, mixtures thereof, and mixtures of lower alcohols.

41. The process of claim 17 wherein said lignin-containing material is peat, said alcohol in which said product is soluble is selected from the group consisting of methanol, ethanol, mixtures thereof and mixtures of lower alcohols, and said reaction is carried out at a temperature of about 20° C. to about 100° C., and wherein said component is selected from the group consisting of methanol, ethanol, mixtures thereof, and mixtures of lower alcohols.

42. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about −10° to about 150° C., and wherein said component is selected from the group consisting of methanol, ethanol, mixtures thereof, and mixtures of lower alcohols.

43. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about 20° C. to about 100° C., and wherein said component is selected from the group consisting of methanol, ethanol, mixtures thereof, and mixtures of lower alcohols.

44. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about −10° to about 150° C., and wherein said component is selected from the group consisting of methanol, ethanol, mixtures thereof, and mixtures of lower alcohols.

45. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about 20° C. to about 100°C., and wherein said component is selected from the group consisting of methanol, ethanol, mixtures thereof, and mixtures of lower alcohols.

46. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about −10° to about 150° C., and wherein said component is selected from the group consisting of methanol, ethanol, mixtures thereof, and mixtures of lower alcohols.

47. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about 20° C. to about 100° C., and wherein said component is selected from the group consisting of methanol, ethanol, mixtures thereof, and mixtures of lower alcohols.

48. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about −10° to about 150° C., and wherein said component is a hydrocarbon fuel in amounts of about 5 to about 95 weight percent.

49. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about 20° C. to about 100° C., and wherein said component is a hydrocarbon fuel in amounts of about 5 to about 95 weight percent.

50. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about −10° C. to about 150° C., and wherein said component is a hydrocarbon fuel in amounts of about 5 to about 95 weight percent.

51. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about 20° C. to about 100° C., and wherein said component is a hydrocarbon fuel in amounts of about 5 to about 95 weight percent.

52. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about −10° to about 150° C., and wherein said component is a hydrocarbon fuel in amounts of about 5 to about 95 weight percent.

53. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about 20° C. to about 100° C., and wherein said component is a hydrocarbon fuel in amounts of about 5 to about 95 weight percent.

54. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about −10° to about 150° C., and wherein said component is a hydrocarbon fuel in amounts of about 5 to about 95 weight percent.

55. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about 20° C. to about 100° C., and wherein said component is a hydrocarbon fuel in amounts of about 5 to about 95 weight percent.

56. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about −10° to about 150° C., and wherein said component is water in amounts of up to about 30 weight percent.

57. The process of claim 17 wherein said lignin-containing material is peat, said alcohol in which said product is soluble is selected from the group consisting of methanol, ethanol, mixtures thereof, and mixtures of lower alcohols, and said reaction is carried out at a temperature of about 20° C. to about 100° C., and wherein said component is water in amounts of up to about 30 weight percent.

58. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about −10° to about 150° C., and wherein said component is water in amounts of up to about 30 weight percent.

59. The process of claim 17 wherein said lignin-containing material is wood, said alcohol in which said product is soluble is selected from the group consisting of methanol, ethanol, mixtures thereof, and mixtures of lower alcohols, and said reaction is carried out at a temperature of about 20° C. to about 100° C., and wherein said component is water in amounts of up to about 30 weight percent.

60. The process of claim 17 wherein said lignin-containing material is bagasse, said alcohol in which said prduct is soluble is selected from the group consisting of methanol, ethanol, mixtures thereof, and mixtures of lower alcohols, and said reaction is carried out at a temperature of about −10° to about 150° C., and wherein said component is water in amounts of up to about 30 weight percent.

61. The process of claim 17 wherein said lignin-containing material is bagasse, said alcohol in which said product is soluble is selected from the group consisting of methanol, ethanol, mixtures thereof, and mixtures of lower alcohols, and said reaction is carried out at a temperature of about 20° C. to about 100° C., and wherein said component is water in amounts of up to about 30 weight percent.

62. The process of claim 17 wherein said lignin-containing material is lignin, said alcohol in which said product is soluble is selected from the group consisting of methanol, ethanol, mixtures thereof, and mixtures of lower alcohols, and said reaction is carried out at a temperature of about −10° to about 150° C., and wherein said component is water in amounts of up to about 30 weight percent.

63. The process of claim 17 wherein said lignin-containing material is lignin, and alcohol in which said product is soluble is selected from the group consisting of methanol, ethanol, mixtures thereof, and mixtures of lower alcohols, and said reaction is carried out at a temperature of about 20° C. to about 100° C., and wherein said component is water in amounts of up to about 30 weight percent.

* * * * *